US008407833B2

(12) United States Patent
Sauter et al.

(10) Patent No.: US 8,407,833 B2
(45) Date of Patent: Apr. 2, 2013

(54) DEFORMABLE SUPPORTING ELEMENT AND RECLINING SYSTEM

(75) Inventors: Michael Sauter, Neftenbach (CH); Flavio Campanile, Schwerzenbach (CH)

(73) Assignee: EMPA Eidg. Materialprufungs—und Forshungsanstalt, Dubendorf (CH)

( * ) Notice: Subject to any disclaimer, the term of this patent is extended or adjusted under 35 U.S.C. 154(b) by 0 days.

(21) Appl. No.: 13/477,290

(22) Filed: May 22, 2012

(65) Prior Publication Data

US 2012/0240335 A1 Sep. 27, 2012

Related U.S. Application Data

(63) Continuation of application No. PCT/EP2010/067899, filed on Nov. 22, 2010.

(30) Foreign Application Priority Data

Nov. 23, 2009 (CH) ..... 1797/09

(51) Int. Cl.
*A47C 23/06* (2006.01)

(52) U.S. Cl. ..... 5/238; 5/236.1; 5/611; 5/936

(58) Field of Classification Search ..... 5/933–934, 5/936, 600, 611, 613, 238, 236.1
See application file for complete search history.

(56) References Cited

U.S. PATENT DOCUMENTS

| | | | | |
|---|---|---|---|---|
| 5,531,658 | A | | 7/1996 | Liao |
| 5,640,729 | A | * | 6/1997 | Marino ..... 5/607 |

FOREIGN PATENT DOCUMENTS

| | | | |
|---|---|---|---|
| AT | 000168 | U1 | 4/1995 |
| DE | 19632611 | A1 | 2/1998 |
| DE | 10307916 | A1 | 9/2004 |
| EP | 0674893 | A2 | 10/1995 |
| EP | 0788786 | A2 | 8/1997 |
| WO | 9730674 | A1 | 8/1997 |
| WO | 0066061 | A1 | 5/2000 |

OTHER PUBLICATIONS

International Search Report for PCT/EP2010/067899 dated Mar. 3, 2011.

* cited by examiner

*Primary Examiner* — Fredrick Conley
(74) *Attorney, Agent, or Firm* — Pearne & Gordon LLP

(57) ABSTRACT

The invention relates to a deformable support element for use in a bed system, and to a bed system comprising the support elements. The bed system is suited in particular for use in the prevention of the development of decubitus by recumbent patients. The support element according to the invention consists of a support plate, flexible edge elements connected at each end to the support plate allowing for a directed movement of the end of the support plate out of an unloaded position, and one or more actuators beneath the support plate for deforming the support plate. The invention is advantageously characterized in that the support plate of the support element can take on a straight shape by the actuation of the actuator or actuators or can be deformed into an undulated shape or into a movement that is directed upward or downward.

17 Claims, 5 Drawing Sheets

DEFORMABLE SUPPORTING ELEMENT AND RECLINING SYSTEM

CROSS-REFERENCE TO RELATED APPLICATIONS

This application is a continuation of International Application No. PCT/EP2010/067899 filed on Nov. 22, 2010, which claims the benefit of Swiss Patent Application No. 2009-CH-01797 filed Nov. 23, 2009. The entire disclosures of the prior applications are incorporated herein by reference in their entireties.

TECHNICAL FIELD

The invention relates to a deformable support element and to a bed system comprising the inventive support elements corresponding to the independent claims. The bed system is suited in particular for use in the prevention of the development of decubitus by recumbent patients.

STATE OF THE ART

Anti-sores beds for the prevention of a pressure sore have already become known in the state of the art. Through the reduced blood flow of the resting surface of the patient's body on the mattress, necrosis and open ulcers ("bedsores") will occur at these places. For this reason, DE19632611 for example proposes to change the pressure distribution in a bed through a plurality of pistons, movably integrated in the resting surface and connected together through a balancing container, so that they can adapt to the patient's body shape. With the same purpose, DE10307916 discloses a micro-integrated dynamically adaptable patient support and utility patent document AT000168U1 a sub-mattress assembly with integrated hydraulic buffer.

EP0788786 describes an embodiment with a central shaft to which a plurality of slats of a slatted frame are attached. When the central shaft is rotated, the shape and position of these slats is changed. These slats are hooked at one end and fastened at the other end in such a fashion that only a movement within the plane of the slat is possible.

WO0066061 discloses on the other hand an anti-sores bed wherein longitudinal cradle means can be vertically extended. The cradle means are fastened to a support surface. The shape of a support surface, centrally fixed, can be modified in this simple manner and the position of the patient can be influenced.

Most systems that have become known can however only be used when bedsores have already occurred in a patient. They are only poorly or not at all suited for the prevention of bedsores. However, in order to reduce the high care costs entailed by patients suffering from bedsores, a system is needed that can be used already at an earlier stage.

An additional disadvantage of the embodiments that have become known in the prior art is that no conventional foam mattresses can be used.

REPRESENTATION OF THE INVENTION

It is an aim of the invention to produce a bed system that can be used for the prevention and therapy of bedsores.

It is another aim of the invention to produce a bed system wherein a foam mattress can be used.

It is another aim of the invention to propose a support element that is easy to produce, on which a bed system for the prevention and therapy of bed-sores can be produced.

It is another aim of the invention to propose a support element that is easy to produce and that achieves its deformability essentially on the basis of the combination of flexurally rigid and flexible elements.

It is another aim of the invention to propose a support element that is easy to produce and that is characterized by a reduced number of parts.

According to the invention, this aim is achieved with a deformable support element for use in a bed system and with a bed system having the characteristics of the respective independent claims.

According to the invention, this aim is achieved in particular with a deformable support element for use in a bed system, including:

- an elongated support plate with a flexurally rigid middle part and two flexible parts located each sideways to the flexurally rigid middle part, wherein the support plate has an upper side and a lower side, two lateral sides and two extremities;
- two edge supports;
- flexible edge elements, of which respectively one edge element is connected with one end of the support plate, said flexible edge elements allowing a directed movement of the flexible parts of the support plate out of an unloaded configuration, in which the edge elements each rest on the edge support, when loaded upwards and inwards to the middle part of the support plate; and
- one or several actuators that for the purpose of deforming the support plate is resp. are arrayed between the edge elements and beneath the support plate.

When the actuators are activated, the support plate of the support element can advantageously take on a straight shape or be deformed in an undulated shape or in a movement directed upwards or downwards. It is thus suitable for moving recumbent patients in a targeted fashion and preventing bed sores.

A guide element placed under the support plate can advantageously take on different forms and shapes. It is thus conceivable to use a triangle having two branches with a connection point to the support plate. It is also possible to produce a spring construction with two connection points to the support plate. This enables a directed movement of the flexurally rigid part upwards or downwards. In a further embodiment, straps fastened each laterally to the support plate or to the underside of the support plate, are used.

A joint can advantageously be placed respectively between the flexible edge elements and the edge supports.

The flexurally rigid middle part of the support plate is 5 to 70 times, and preferably 20 to 50 times, more flexurally rigid than the flexible part of the support plate, comprises 10 to 50% of the length of the support plate, and is centered around the middle of the support plate. The flexible part of the support plate is either thinner than the flexurally rigid middle part of the support plate or has material cutouts or is made of another material with lower rigidity. The aim is that the flexurally rigid part does hardly or not at all deform when forces are applied and serves as guide for the flexible parts. The flexible parts advantageously bend when a force is applied and thus cause the construction to take on the desired deformation. Depending on the actuators, the support element can thus take on a straight shape or can be deformed in a wave shape (sinusoidal) or in a movement directed upwards or downwards.

For optimum deformation, the actuators engage in the transition zone between the flexurally rigid middle part and the flexible part in order to induce a force.

Generally, the support element can be made in one piece by injection molding or in several pieces, wherein the support plate can be glued with the flexible edge elements and the guide elements. All parts of the support element can be made of unreinforced or glass-fiber reinforced synthetic material.

Below the actuators and the guide element, there should be a bottom of the support element that absorbs the force of the actuators.

The edge supports can have a profile and a blocking device in order to be connected with a lateral guide rail of the bed system.

This aim is also achieved with a bed system comprising a number of deformable support elements according to one of the preceding claims, wherein the support elements are arranged next to one another and form the slatted frame of the bed system. In this respect, the guide element can be different from various support elements of the bed system. It is thus possible to achieve that different parts of the human body can be moved differently, for example the arms, torso and legs in the shown undulated form and hips and posterior in the shown movement directed upwards and downwards.

Further advantageous embodiments are indicated in the dependent claims.

SHORT DESCRIPTION OF THE FIGURES

The invention is described with the aid of the attached figures, wherein

FIG. 2 shows an overall view of an inventive support element with pneumatic actuators, wherein

WAYS OF EXECUTING THE INVENTION

Figure 1:
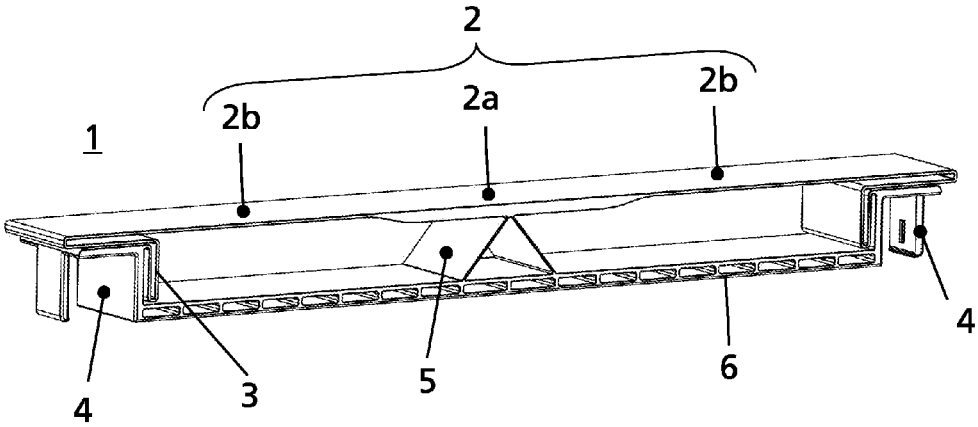
FIG. 1 shows an overall view of an inventive support element.

An overall view of a deformable support element 1 according to the present invention is shown in FIG. 1. It consists of an elongated support plate 2 constituted of two parts: a flexurally rigid middle part 2*a* and two flexible parts 2*b*, wherein one flexible part 2*b* each is placed to the side of the flexurally rigid middle part. The elongated support plate 2 has as external boundary two shorter extremities and two longer lateral sides. The present invention makes use of the fact that the flexible part 2 can be bent or is generally deformable through the application of a force, whilst the flexurally rigid part 2*a* does not or only hardly change shape and can thus guides both connected parts 2*b* to the desired shape. For this inventive purpose, the flexurally rigid middle part 2*a* of the support plate 2 is 5 to 70 times more flexurally rigid than the flexible part 2*b* of the elongated support plate 2. In a preferred embodiment, the part is 20 to 50 times more flexurally rigid than the flexible part 2*b*. From a construction point of view, the flexible part 2*b* of the support plate 2 can be thinner than the flexurally rigid middle part 2*a* of the support plate 2 (as shown in FIG. 1). It is also conceivable that the flexible part 2*b* of the support plate 2 has material cutouts at the edge or in the middle (not represented) or is made of another material with lower rigidity.

The support element 1, which serves as slat in a slatted frame of a bed, has a length corresponding to the width of a bed and a width between 300 mm and maximum 150 mm. These measurements allow a good deformability of the support element 1. The flexurally rigid middle part 2*a* will then comprise 10 to 50% of the length of the support plate 2 and be centered lengthwise around the middle of the support plate 2. The length relates to the length between edge elements 3, i.e. the width of the bed (without possible side rails of the bed).

Figure 5:
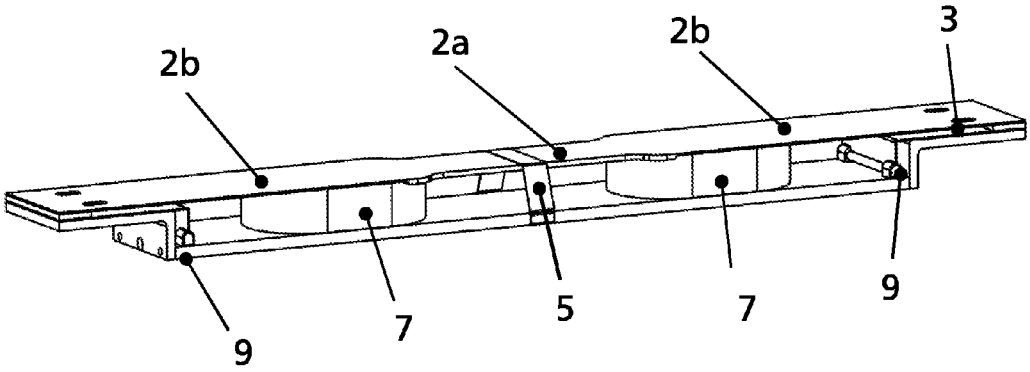
FIG. 5 shows a further embodiment of the invention, in unloaded state.

A flexible edge element 3 is each located at a shorter extremity of the elongated support plate 2 and is connected with the support plate 2 so that the edge element 3 and the extremity will merge with one another. Beneath the edge element 3 is an edge support 4, with which each of the edge elements 3 can be connected. The edge element 3 could also be connected at that point with the bottom 6. The edge supports 4 have, as shown, a profile and a blocking device in order to be connected with two lateral guide rails 8 of the bed system, as shown in FIG. 5. The edge supports 4 are each adapted to grip the guide rail 8. The guide rail 8 is designed as hollow profile. FIG. 5 shows by way of example for the purpose of simplification only a selected support element 1. In practice, however, there will be a plurality of support elements 1 next to one another on the guide rail 8.

The support plate 2 has a surface (upper side) oriented towards the patient and on which a mattress, which can be a foam mattress etc., is placed, as well as a surface (lower side) oriented away from the patient. On this downwards-facing surface, at least one flexible guide element 5 can be fastened to the flexurally rigid part 2*a*. This guide element 5 guides the movement of the flexurally rigid middle part 2*a* when the support element 1 is deformed.

Figure 2:
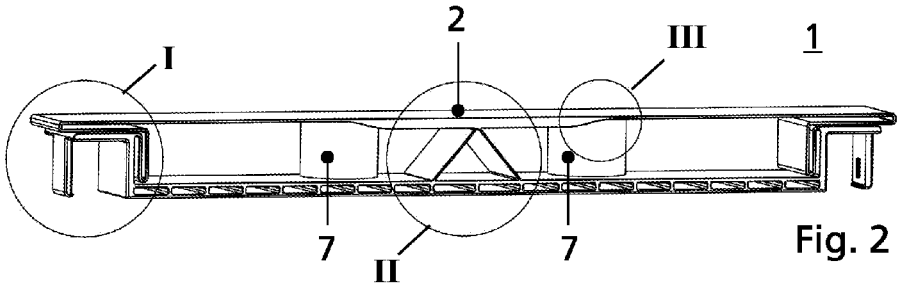

FIG. 2 shows an overall view of an inventive support element, wherein additionally two actuators 7 are shown. The actuators preferably work with air. The number of actuators 7 can vary depending on the embodiment and desired shape modification. The actuators 7 are advantageously located on each side of the guide elements 5 between the edge elements 3 below the support plate 2. The actuators 7 advantageously apply their force in the transition zone between the flexurally rigid middle part 2*a* of the support plate 2 and the flexible part 2*b* of the support plate 2. They provide for a targeted deformation of the inventive support element 1 by applying force on the support plate 2.

Below the actuators 7 and the guide element 5 there can be a bottom 6 that absorbs the force of the actuators 7. As bottom 6, a sandwich construction can for example be used. As can be seen in FIG. 2, the bottom 6 extends between the two edge supports 4.

Figure 2A:
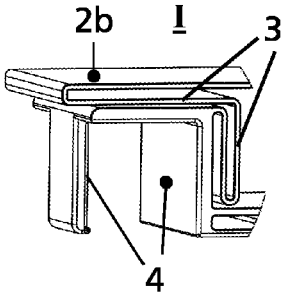
FIG. 2*a-c* illustrate the details I, II, III of FIG. 2, FIG. 3*a-d* show different shapes that can be generated by the inventive support element.

FIG. 2*a* shows the detail I of FIG. 2 and an embodiment of the flexible edge element 3. The edge element 3 is constructed in such a manner that a directed movement of the flexible part 2*b* of the support plate 2 upwards and inwards towards the middle part 2*a* of the support plate 2 out of the unloaded position resp. configuration is possible. A movement directed downwards is however prevented in that the edge element 3 rests on the edge support 4 when the force is applied. This prevents for example the part from breaking or a person who is sitting on the edge of the bed from falling. The proposed construction also prevents a movement directed outwards. The flexible edge element 3 in the illustrated embodiment is made of a meander running with its two sides parallel to the edge elements 4. The outer side of the meander is guided further over the edge element 4 and is connected there with the flexible part 2*b* of the support plate 2. Other constructions of this edge element 3 are conceivable, inasmuch as the function is preserved that the required guiding is achieved. The size of the meander in particular can vary.

Figure 2B:
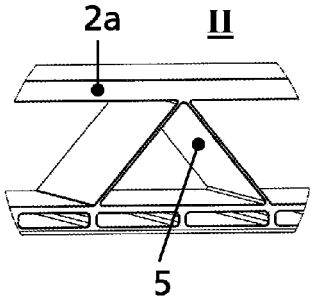
Figure 2C:
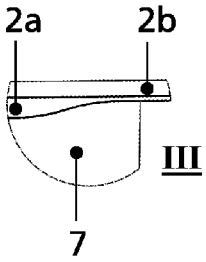

FIG. 2*b* shows the detail II of FIG. 2 and the connection between the support plate 2 and the guide element 5. FIG. 2*c* shows the detail III of FIG. 2. It shows in particular that the actuators 7 apply their force in the transition zone between the flexurally rigid middle part 2*a* of the support plate 2 and the flexible part 2*b* of the support plate 2.

In one embodiment, the support element 1 can be made in one piece by injection molding. It is also conceivable to make the pieces individually and thus to glue the support plate 2 with the flexible edge elements 3 and the guide element 5. Thick-film bonding for example is suited. The support element 1 is advantageously made of unreinforced or glass-fiber reinforced synthetic material.

FIGS. 3*a-d* show by way of example different shapes that can be generated by the inventive support element 1. This can be achieved by applying force in the actuators 7 and the use of different guide elements 5. As already shown in FIG. 2, the support plate 2 of the support element 1 can take on a straight shape by simultaneously activating the actuators 7.

Figure 3A:
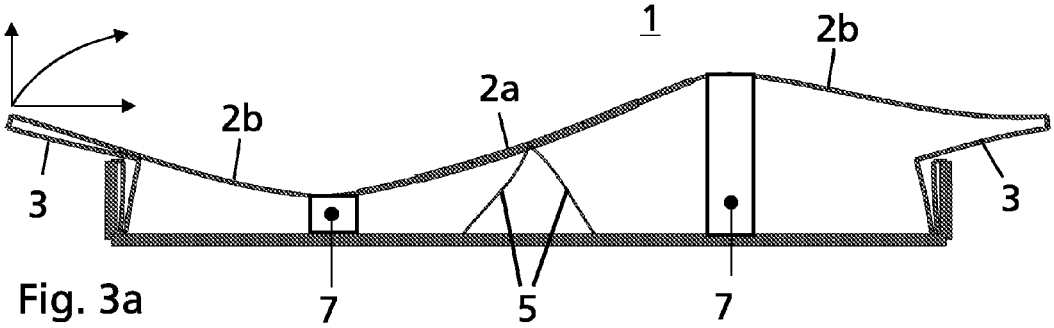
Figure 3B:
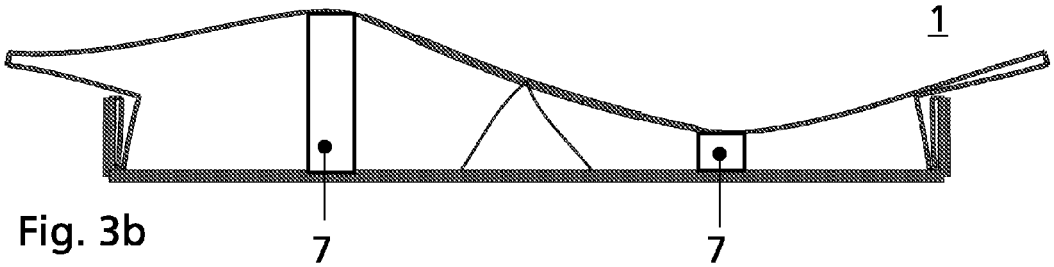

According to FIGS. 3*a, b*, the support plate 2 can be moved in a sinusoidal wave shape. This occurs by activating one of the two actuators 7 whilst the other is respectively disengaged. The triangular guide element 5 holds the flexurally rigid middle part 2*a* of the support plate 2 in position and guides the movement. Both branches are then rotated. The movement directed upwards and inwards of the edge element 3 is shown in FIG. 3*a* on the left side by way of example. As a result of both movements, the extremity of the support plate moves in an inwards curve.

Figure 3C:
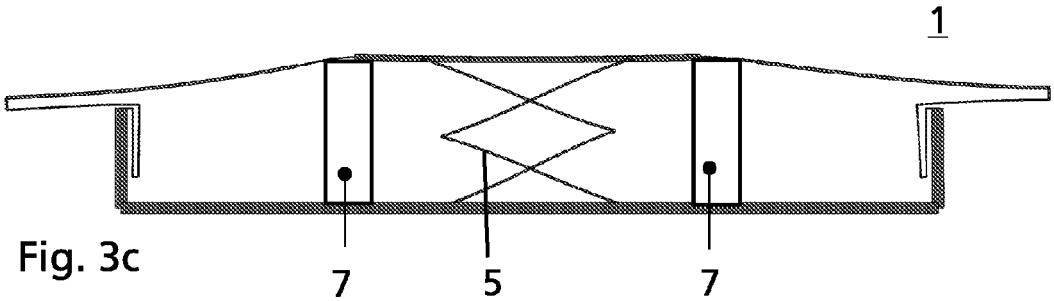
Figure 3D:
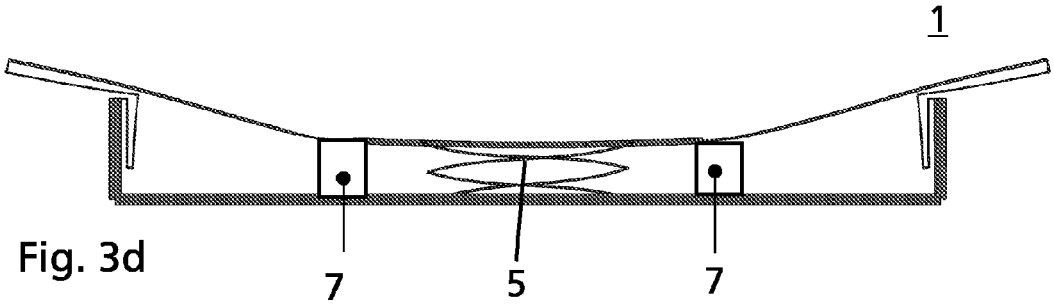

In FIGS. 3*c, d*, a spring element is used as guide element 5, wherein the element is connected at two points to the flexurally rigid part 2*a* of the support plate 2. A movement directed upwards or downwards is thus possible by simultaneously activating or disengaging the actuators 7.

Figure 4A:
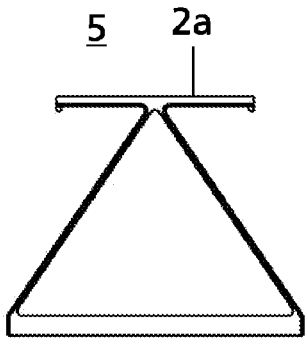
FIG. 4*a-c* show different embodiments of the flexible guide elements.
Figure 4B:
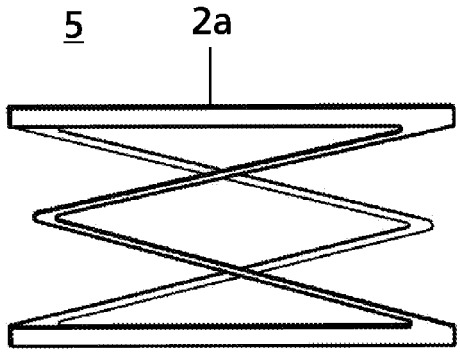
Figure 4C:
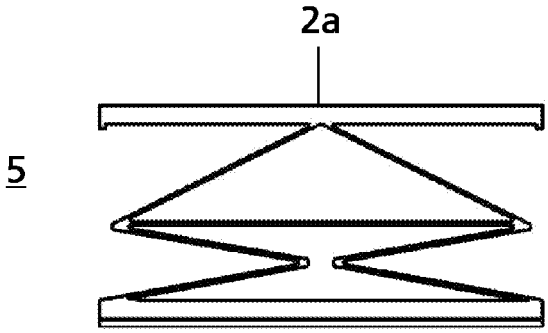

FIGS. 4*a-c* show different embodiments of the flexible guide elements 5. These can be a triangle with a connection point to the support plate 2 (FIG. 4*a*) or a spring construction with two connection points to the support plate 2.

FIG. 5 shows a further embodiment of the invention in an unloaded situation. In this embodiment, lateral straps are used as guide elements 5. As straps, so-called belt straps can be used as are also used in rucksacks. These are made of polypropylene and are hardly extensible. The width is variable, but it should not however exceed the width of the elongated support plate. The thickness is also variable, it can for example be 1.4 mm. The edge elements 3 in this embodiment are provided with a joint 9, so as to allow a directed movement of the flexible parts 2*b* of the support plate 2 out of an unloaded configuration, in which the edge elements 3 each rest on the edge supports 4, when loaded upwards and inwards to the middle part 2*a* of the support plate.

Figure 6:
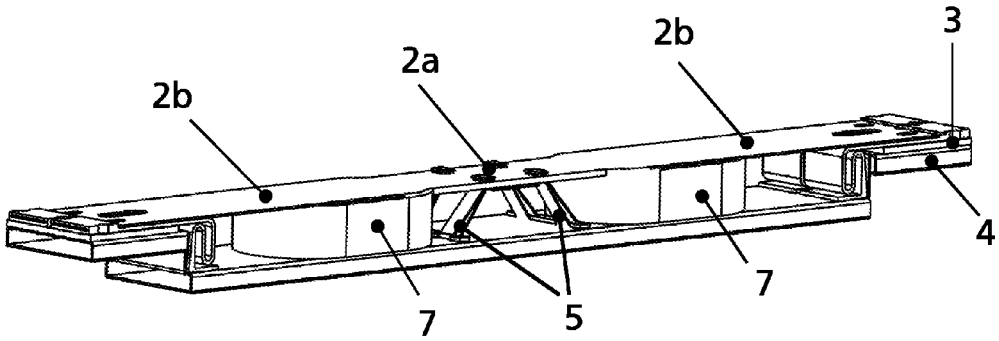
FIG. 6 shows a further embodiment of the invention, in unloaded state.

FIG. 6 shows a further embodiment of the invention in an unloaded state. In this embodiment, straps are also used as guide elements 5. These straps are fastened to the bottom 6 and to the flexurally rigid part 2*a* of the support plate 2. Said belt straps are again used. On each side, two straps each are stretched between said elements, wherein a gap has been left between the straps. Edge elements 3, edge supports 4 and the transition between the flexible parts 2*a* and the edge elements 3 are executed as in the embodiment of FIG. 1.

Figure 7:
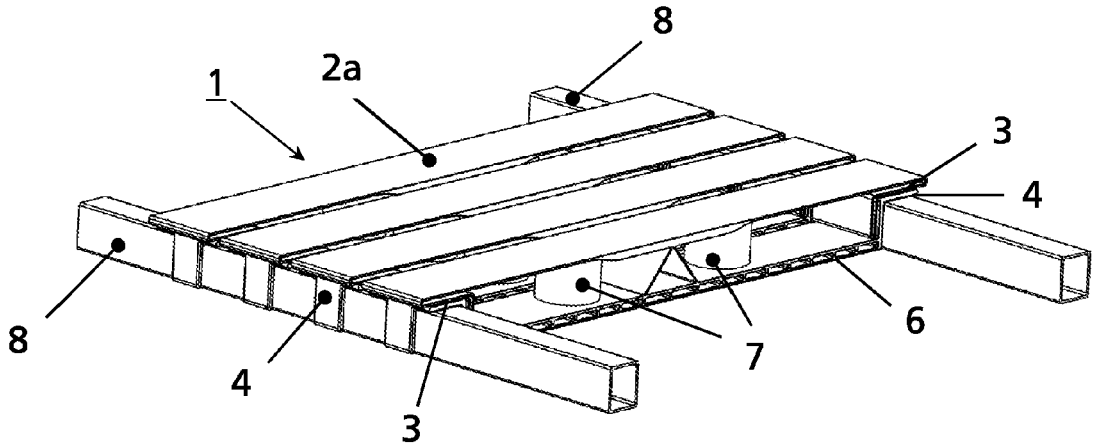
FIG. 7 shows several support elements with a lateral guide rail of the bed system in an unloaded position or configuration.

The present invention also relates to a bed system comprising a number of deformable support elements 1, wherein the support elements are arranged next to one another and form the slatted frame of the bed system, as illustrated in FIG. 7. In this respect, the guide element 5 of different support elements 1 of the bed system can be different. It is thus possible to achieve that different parts of the human body can be moved differently, for example the arms, torso and legs in the shown undulated form and hips and posterior in the shown movement directed upwards and downwards. The actuators 7 of each support element 1 in the bed system can be controlled individually, so that only individual parts of slats of the slatted frame can be moved. The bed system advantageously has two lateral guide rails 8 onto which an edge support 4 of the support element 1 for example can each be fastened by locking. The proposed bed system can advantageously be used for the prevention of the development and for the therapy of decubitus. The movement of the support plate (amplitude of the undulations, height etc.) can be adjusted according to the need of the patient by activating the actuators. The system is advantageously composed of few components and can thus be less expensive to produce, more economical to maintain and easier to repair. In particular, it is easily possible to replace individual support elements 2 if this appears necessary. The system can advantageously also be used with a foam mattress.

LIST OF REFERENCE NUMBERS

1 support element
2 support plate
2*a* flexurally rigid part of the support plate 2
2*b* flexible part of the support plate 2
3 edge element
4 edge support
5 guide element
6 bottom
7 pneumatic actuator
8 guide element
9 joint

The invention claimed is:

1. Deformable support element (1) for use in a bed system, comprising:

an elongated support plate (2) having a flexurally rigid middle portion (2*a*) and two flexible portions (2*b*) located each sideways to the flexurally rigid middle portion (2*a*), wherein the support plate (2) has an upper side and a lower side, two lateral sides and two ends;

two edge supports (4);

flexible edge elements (3), of which respectively one edge element (3) is connected with one end of the support plate (2), said flexible edge elements (3) allowing a directed movement of the flexible portions (2*b*) of the support plate (2) through loading upwards and inwards to the middle portion (2*a*) of the support plate (2) out of an unloaded configuration, in which the edge elements (3) each rest on the edge supports (4); and one or several actuators (7) that for the purpose of deforming the support plate (2) is arranged between the edge elements (3) and beneath the support plate (2).

2. Deformable support element (1) according to claim 1, with at least one guide element (5) fixed under the flexurally rigid middle portion (2*a*) of the support plate and guiding a movement of the flexurally rigid middle portion (2*a*) during a deformation of the support elements (1).

3. Deformable support element (1) according to claim 2, characterized in that the guide element (5) is a triangle with a connection point to the support plate (2) or a spring construction with two connection points to the support plate (2).

4. Deformable support element (1) according to claim 2, with straps as guide element (5), which are fastened each laterally to the support plate (2) or to the lower side of the support plate (2).

5. Deformable support element (1) according claim 2, characterized in that for the purpose of deforming the support plate (2) at least one actuator (7) is arranged between each of the edge elements (3) and the guide element (5) and beneath the support plate (2), respectively.

6. Deformable support element (1) according to claim 2, characterized in that the support element (1) has a bottom extending between the two edge supports (4) and located below the actuator or actuators (7) and the guide element (5).

7. Deformable support element (1) according to claim 2, characterized in that a joint (9) is provided each between the flexible edge elements (3) and the edge supports (4).

8. Deformable support element (1) according to claim 1, characterized in that the actuators (7) apply their force in the transition zone between the flexurally rigid middle portion (2*a*) of the support plate (2) and the flexible portion (2*b*) of the support plate (2).

9. Deformable support element (1) according to claim 1, characterized in that the flexurally rigid middle portion (2*a*) of the support plate (2) is 5 to 70 times, and preferably 20 to 50 times, more flexurally rigid than the flexible portion of the support plate (2).

10. Deformable support element (1) according to claim 1, characterized in that the flexible part of the support plate (2) is thinner than the flexurally rigid middle part (2*a*) of the support plate (2) or in that the flexible portion (2*b*) of the support plate (2) has material cutouts or in that the flexible portion (2*b*) is made of another material with lower rigidity.

11. Deformable support element (1) according to claim 1, characterized in that the flexurally rigid middle portion (2*a*) comprises 10 to 50% of the length of the support plate (2) between the edge elements (2), and is centered around the middle of the support plate (2).

12. Deformable support element (1) according to claim 1, characterized in that the support element (1) is made in one piece by injection molding or the support plate (2) is glued with the flexible edge elements (3) and a guide element (5).

13. Deformable support element (1) according to claim 1, characterized in that the support element (1) is made of unreinforced or glass-fiber reinforced synthetic material.

14. Deformable support element (1) according to claim 1, characterized in that the edge supports (4) have a profile and a blocking means in order to be connected with a lateral guide rail (8) of the bed system.

15. Deformable support element (1) according to claim 1, characterized in that the support plate (2) of the support element (1) is deformable in an undulated shape or in a movement directed upwards or downwards by activating the actuator or actuators (7).

16. Bed system comprising a number of deformable support elements (1), wherein the support elements (1) are arranged next to one another and form the slatted frame of the bed system and wherein there are two lateral guide rails (8) onto which an edge support (4) of the support element (1) can each be fastened, wherein each deformable support element (1) comprises:

an elongated support plate (2) with a flexurally rigid middle portion (2*a*) and two flexible portions (2*b*) located each sideways to the flexurally rigid middle portion (2*a*), wherein the support plate (2) has an upper side and a lower side, two lateral sides and two ends;

two edge supports (4);

flexible edge elements (3), of which respectively one edge element (3) is connected with one end of the support plate (2), said flexible edge elements (3) allowing a directed movement of the flexible portions (2*b*) of the support plate (2) through loading upwards and inwards to the middle portions (2*a*) of the support plate (2) out of an unloaded configuration, in which the edge elements (3) each rest on the edge supports (4); and one or several actuators (7) that for the purpose of deforming the support plate (2) is arranged between the edge elements (3) and beneath the support plate (2).

17. Bed system according to claim 16, characterized in that a guide element (5) is provided in each support element (1) and in that the guide element (5) of different support elements (1) of the bed system is different.

* * * * *